US007082616B1

(12) United States Patent
Murray

(10) Patent No.: US 7,082,616 B1
(45) Date of Patent: Aug. 1, 2006

(54) KARPET KNEES

(76) Inventor: Michael John Murray, 2081 Skelton Rd., Gainesville, GA (US) 30504

( * ) Notice: Subject to any disclaimer, the term of this patent is extended or adjusted under 35 U.S.C. 154(b) by 0 days.

(21) Appl. No.: 11/243,849

(22) Filed: Oct. 5, 2005

(51) Int. Cl.
*A41D 13/00* (2006.01)

(52) U.S. Cl. ..... 2/24

(58) Field of Classification Search ..... 2/22–24, 2/62, 79, 69, 227, 242, 267, 247–253, 256, 2/257, 455, 404, 407, 911; 128/881, 882; 602/23, 26, 61, 62, 63
See application file for complete search history.

(56) References Cited

U.S. PATENT DOCUMENTS 4,116,236 A * 9/1978 Albert ..... 602/26
6,058,505 A * 5/2000 Bettencourt ..... 2/24
6,751,804 B1 * 6/2004 Warner et al. ..... 2/23

* cited by examiner

*Primary Examiner*—Tejash Patel

(57) ABSTRACT

To enhance comfort when kneeling down and working with knee pads. By sewing on the inside of knee pad four triangular pockets running somewhat parallel with pockets opposite of each other provides the mechanics of this invention. All four pockets contain all four corners of 4"5" approx. carpet scrap securely.

5 Claims, 3 Drawing Sheets

Fig 1. rear view
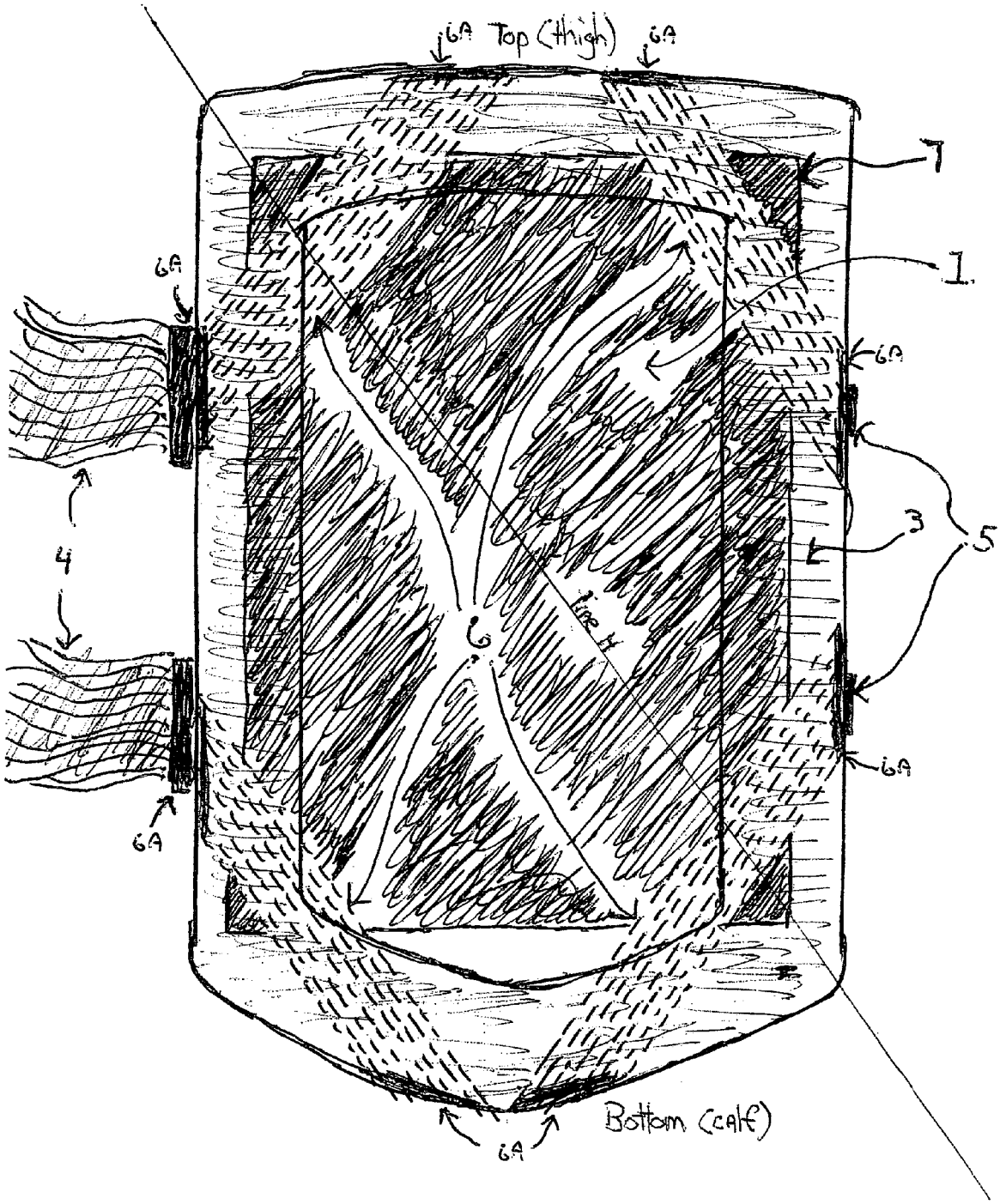

Fig 2. front view
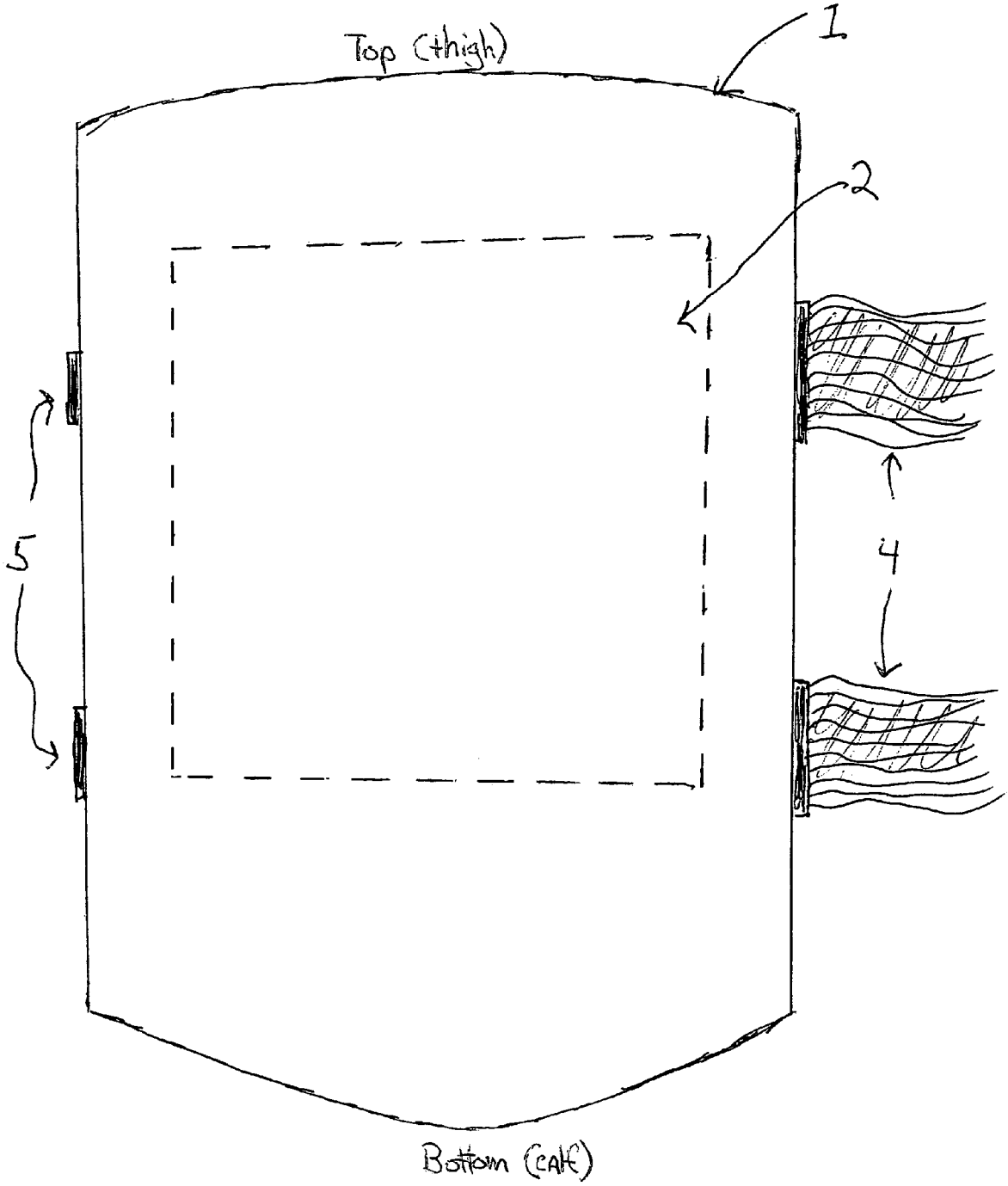

Fig. 3 side view
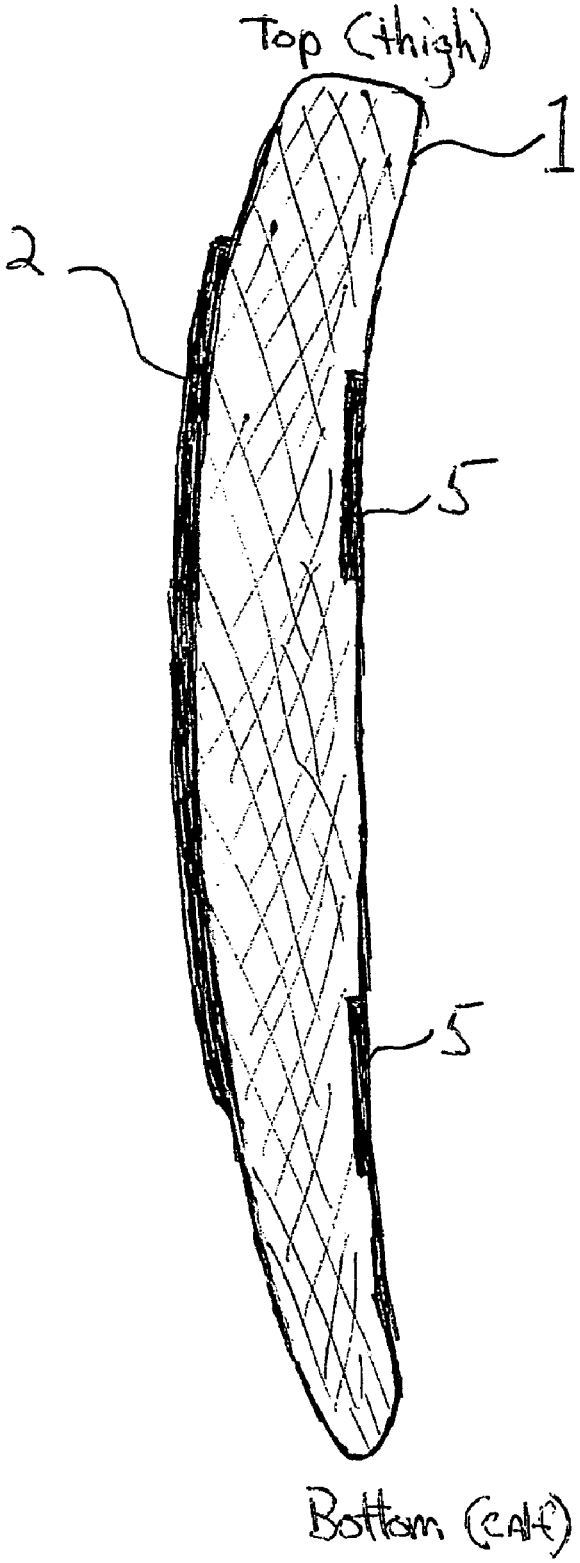

KARPET KNEES

BACKGROUND OF INVENTION

1. Field of Invention

The entire scope of this invention is to identify and rectify a current emphasis on comfort when kneeling down while wearing knee pads. Much attention has been paid to improve distribution of weight transferred from users' knee to knee pad or made to be removable or by altering the configuration of the inside of knee pad to accommodate users' knee a little differently for comfort.

This can be done by adding extra padding or gel to areas where the patella meets the knee pad. Many knee pads on the market utilize removable and replaceable inner elements such as cushions as cushions or gel packs. This invention also employs the use of removable and replaceable inner elements, however the inner element being a piece of carpet scrap simply held inside the knee pad by straps sewn into corners on inside of knee pad to form triangular pockets makes the source of comfort easier to obtain with little or no cost. Carpet scraps are readily available to most people who wear knee pads on a daily basis and by simply cutting a scrap 4"×5" approx. and inserting into pockets. This delivers instant improvement for comfort enhancement.

2. Description of Prior Art

All knee pads have the same goal, to provide comfort on users' knees when kneeling down. Depending on style, materials used in fabrication, or lack of materials used in fabrication are factors that dictate the level of comfort obtained in all knee pads on the market. Most knee pads are shelled with a hard plastic plate where the knee pad meets the floor. A shell combined with either textile type padding or batting, or the use of gel packs either sewn into the knee pad or made to be removable and replaceable are the most common avenues for comfort.

Gel packs are comfortable and fit the knee by conforming to the users' knee. However, they can rupture and if constructed internally in knee pad as not to be removable, the knee pad is ruined and the entire knee pad must be replaced. Rubber or a textile pad can also be replaced in existing knee pads. A lot of manufactures make knee pads with replaceable pads or gel packs.

Total comfort for excessive use on ones' knees is elusive but by using just a piece of carpet scrap about 4"×5" and installing it inside of the knee pad with pile side facing users' knee and with backing facing the inside of knee pad, cheap additional comfort is immediately obtained. This avenue of comfort had been done before but none has been done utilizing scrap carpet as the source for comfort.

As like all removable and replaceable cushions, they wear out. So does carpet, probably a little sooner but it's easier to obtain, especially for someone in the flooring trade, where I believe most users of knee pads reside. Practicality would improve since no trip would be made to replace cushion. Simply cut a small piece of carpet and insert its corners into the four triangular pockets on each corner of inside of knee pad. The users' weight, length of time on knees, and sweat would all be factors determining when to change the carpet scrap.

SUMMARY

All this invention does is to slightly modify a set of cheap available knee pads to enhance comfort ability by using carpet as the source for comfort. Four reinforced straps sewn into inside corners of knee pads provide the mechanics used to contain scrap.

DESCRIPTION OF FIG. 1, FIG. 2, AND FIG. 3

FIG. 1 depicts looking inside of knee pad where knee pad comes in contact of users' knee. Top (thigh) and bottom (calf) denote position of knee pad.

FIG. 2. Front view depicting plastic shell (optional).

FIG. 3. Side view.

DESCRIPTION OF PREFERRED EMBODIMENTS

This is a knee pad fabricated with a cloth or suitable fabric encompassing a dense textile batting throughout the peripheral of entire knee pad to allow a cushion for comfort when user kneels down on a hard surface be it the floor, ground, or any case where comfort for ones knees is desired. FIG. 1 shows the rear view of knee pad (1). An optional plastic shell can be fabricated on front view of knee pad as for more protection. The plastic (2) shell (optional) FIG. 2 front view shows its location and is riveted to knee pad by use of metal rivets. Most knee pads are made this way. As seen of FIG. 1 the entire perimeter of knee pad is constructed with extra padding to form a rim of padding. This is denoted by numeral 3. Numeral 4 denotes the straps used to fasten knee pads to knee by wrapping around the users leg and held by a clip or a button denoted by numeral 5. The uniqueness and novelty of' 'Karpet Knees' are denoted by numeral 6 which shows four reinforced straps sewn onto the perimeter of knee pad only on sections denoted by 6A. There are eight points on perimeter of interior denoted by 6A. This allows all four straps to work together to contain an approx. 4"×5" carpet strap by inserting carpet scrap underneath all four straps for containment and stability of carpet scrap. As seen by viewing line H, straps 6 are parallel to each other when from the perspective of opposite corners. Numeral 7 denotes approx. 4"×5" carpet scrap being contained by four straps 6. FIG. 3 denotes the side view depicting by numeral 2 and fastener, numeral 5 which could be either a clip or button.

I claim:

1. A kneepad positioned about the knees comprising:

a kneepad body having inner and outer surfaces with upper, lower, and side edges;

a pair of parallel, spaced fastening straps secured to the kneepad body and fastened about the knees;

a pair of upper and lower corner reinforcing straps sewn to the inner surface of the kneepad body at each of the respective corners;

each of the upper corner reinforcing straps being substantially positioned between the upper and side edges, respectively;

each of the lower corner reinforcing straps being substantially positioned between the lower and side edges, respectively;

a removable carpet scrap having a backing and a pile side being approximately four inches in width and five inches in length is positioned within the respective pair of upper and lower corner reinforcing straps on the inner surface of the kneepad body, such that the backing faces the inner surface while the pile side faces the wearer's knee.

2. A kneepad of claim 1 comprising:

a plastic shell being fastened to the outer surface of the kneepad body.

3. A kneepad of claim 2 comprising:

the plastic shell being secured to the kneepad body by metal rivets.

4. A kneepad of claim 1 comprising:

each of the fastening straps being secured about the knees by a clip fastener.

5. A kneepad of claim 1 comprising:

each of the fastening straps being secured about the knees by a button/snap fastener.

* * * * *